US005191772A

United States Patent [19]

Engel

[11] Patent Number: 5,191,772

[45] Date of Patent: Mar. 9, 1993

[54] AUGER-TYPE ICE-MAKING APPARATUS

[75] Inventor: Franklin D. Engel, Englewood, Colo.

[73] Assignee: Pacific Rockies, Inc., Denver, Colo.

[21] Appl. No.: 834,803

[22] Filed: Feb. 13, 1992

[51] Int. Cl.[5] ..... F25C 1/14

[52] U.S. Cl. ..... 62/320; 62/354

[58] Field of Search ..... 62/320, 354, 518; 239/566

[56] References Cited

U.S. PATENT DOCUMENTS

| | | | |
|---|---|---|---|
| 3,233,417 | 2/1966 | Soderberg | 62/354 |
| 3,245,225 | 4/1966 | Wallace | 62/354 |
| 3,247,678 | 4/1966 | Mohlman | 62/534 X |
| 3,354,666 | 11/1967 | Beusch et al. | 62/354 |
| 3,599,877 | 8/1971 | Goldshmeed | 239/566 X |
| 3,769,809 | 11/1973 | Robinson et al. | 62/354 X |
| 4,328,681 | 5/1982 | Sakamoto et al. | 62/157 |
| 4,497,184 | 2/1985 | Utter et al. | 62/354 |
| 4,574,593 | 3/1986 | Nelson | 62/320 |
| 4,741,173 | 5/1988 | Neumann | 62/298 |
| 4,969,337 | 11/1990 | Hida | 62/320 |

*Primary Examiner*—William E. Tapolcai

*Attorney, Agent, or Firm*—Klaas, Law, O'Meara & Malkin

[57] ABSTRACT

An auger type ice making apparatus having a discharge section comprising a modified elbow portion and a discharge tube extending outwardly therefrom with pressure applying apparatus mounted on the upper end of the auger for rotation therewith and located in the modified elbow and having a generally cylindrical outer surface immediately adjacent to the upper end of the auger and a generally conical outer surface extending upwardly therefrom and wherein a portion of the inner surface of the modified elbow comprises an oval surface opposite to the generally conical outer surface and wherein a portion of a radially outwardly extended flange on the upper end of the generally conical outer surface is located in an arcuate recess in the oval surface and with at least one cutter extending radially outwardly from the generally cylindrical outer surface. Also, apparatus is provided for distributing the refrigerant for improved performance.

20 Claims, 1 Drawing Sheet

AUGER-TYPE ICE-MAKING APPARATUS

FIELD OF THE INVENTION

This invention relates generally to ice-making apparatus and more particularly to auger-type, ice-making apparatus.

BACKGROUND OF THE INVENTION

There are a variety of auger-type, ice-making apparatus in commercial use. In some of these apparatus, the ice slurry is pushed by the augers through pressure-producing openings and the ice extruded through the openings is broken off by being moved into contact with an inclined surface. In a modification of this variety of auger-type, ice-making apparatus, a rotating member breaks off the ice after it has been extruded through the openings. In another variety of auger-type, ice-making apparatus, the openings are omitted and a member is attached to and rotates with the auger and ice-breaking means are attached to the member to break the sheath of ice being pushed up by the auger. This latter variety is disclosed in U.S. Pat. No. 3,245,225 which uses several different methods for breaking the sheath of ice, one of which comprises a plurality of circumferentially, spaced-apart, threaded bolts on a member secured to and rotating with the auger. This invention is directed to the latter variety of auger-type, ice-making apparatus with improved structures for obtaining ice that is substantially free of excess water.

BRIEF DESCRIPTION OF THE INVENTION

This invention provides auger-type, ice-making apparatus that has discharge means comprising a modified elbow portion and a discharge tube extending outwardly therefrom and pressure forming means mounted on the auger for rotation therewith and located in the modified elbow for applying pressure on the ice being moved upwardly by the auger.

In a preferred embodiment of the invention, the apparatus for producing the ice particles comprises a housing mounted at a relatively fixed location. A hollow member having a longitudinal axis and a generally cylindrical inner surface is mounted on the housing so that it extends generally in a vertical direction. Temperature reducing means surround the hollow member for controlling the temperature of the hollow member below freezing so as to form a layer of ice on the generally cylindrical inner surface. An auger having a longitudinal axis coinciding with the longitudinal axis of the hollow member is mounted for rotational movement relative to the hollow member. The auger has a generally cylindrical central body portion for providing an ice forming chamber between the generally cylindrical inner surface and the central body portion and has a helically extending flight having an ice shearing edge for removing the layer of ice from the generally cylindrical inner surface and for moving the removed ice in the vertical direction. Support means extend radially outwardly from the hollow member and are spaced a predetermined distance from the upper end of the hollow member. Discharge means are mounted on the support means and have a modified elbow portion and a discharge tube extending outwardly therefrom. Pressure forming means are mounted on the central body portion for rotation therewith and are located in the modified elbow portion for applying pressure on the ice being moved upwardly by the ice shearing edge and flight. The pressure forming means have a generally cylindrical outer surface opposite to and spaced from a portion of the generally cylindrical inner surface and terminating at the upper end of the hollow member and a generally conical outer surface extending upwardly therefrom into the modified elbow portion. In one embodiment of the invention, a plurality of circumferentially spaced apart cutters extend radially outwardly from the generally cylindrical outer surface. Locating means are provided for locating the plurality of cutters so that each of them are equidistantly spaced in opposite circumferential directions from the end of the helically extending flight. The modified elbow portion has an inner surface having an arcuate recess formed therein and extending generally in a horizontal direction. Flange means are located at the upper extremity of the generally conical outer surface and extend radially outwardly therefrom and have at least a portion thereof located in the arcuate recess. The discharge tube has a longitudinal axis with an extension thereof passing through the extended longitudinal axis of the auger. The arcuate recess comprises a partial generally oval surface having a longitudinal axis which extends parallel to the longitudinal axis of the auger but is spaced therefrom a predetermined distance along the longitudinal axis of the discharge tube.

A hollow tube is located in the temperature reducing means and has a plurality of vertically spaced-apart openings formed therein. the openings preferably comprise pairs of opposite openings facing in opposite circumferential directions and having diameters increasing in size from the lowermost opposite pair of openings to the uppermost opposite pair of openings. A refrigerant is supplied to the hollow tube and passes through the openings into the temperature reducing means.

BRIEF DESCRIPTION OF THE DRAWING

An illustrative and presently preferred embodiment of the invention is shown in the accompanying drawings in which.

DETAILED DESCRIPTION OF THE INVENTION

Figure 1:
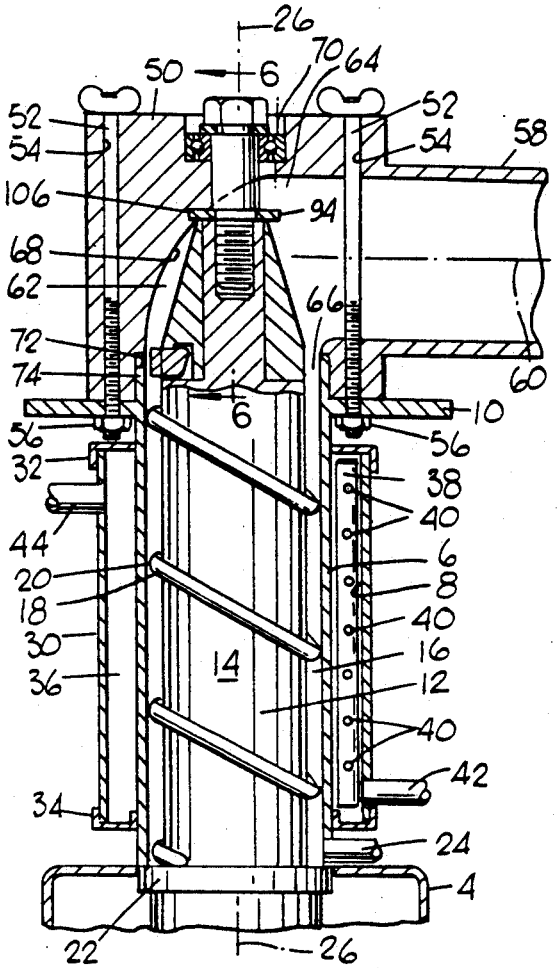
FIG. 1 is a front elevational view with parts in section of a portion of the auger-type, ice-making apparatus of this invention.

In FIG. 1, there is illustrated an auger-type, ice-making apparatus 2 comprising a housing 4 mounted at a relatively fixed location. While the ice making apparatus 2 may be moved to various locations, the housing 4 is at a relatively fixed location when in use. Located in the housing 4, but not shown, are the conventional apparatus for rotating an auger, apparatus for supplying the refrigerant and apparatus for maintaining a supply of water in the ice-making apparatus. A hollow member 6 having a generally cylindrical inner surface 8 is mounted on the housing 4 and extends therefrom in a generally vertical direction when in use. An integral support flange 10 extends radially outwardly from the housing 4.

An auger 12 is mounted for rotation relative to the housing 4 and has a central body portion 14 for providing an ice-forming chamber 16 between the generally cylindrical inner surface 8 and the central body portion 14. The auger 12 is provided with a helically extending flight 18 having an ice shearing edge 20 for removing a layer of ice from the generally cylindrical inner surface 8, formed as described below, and for moving the removed ice in a vertical direction. A bushing 22 mounted on the housing 4 provides for rotation of the auger 12 and provides a seal for the ice forming chamber 16. An inlet tube 24 is connected to a supply of water (not shown) and functions to supply water to the ice-forming chamber 16. The auger 12 and the hollow member 6 have a common longitudinal axis 26.

A hollow sleeve 30 surrounds at least a portion of the hollow member 6 and annular rings 32 and 34 secure the hollow sleeve 30 to the hollow member 6 to form a sealed annular chamber 36. At least one hollow tube 38 is mounted in the sealed annular chamber 36 and has a plurality of vertically spaced-apart openings 40 formed therein. The openings 40 comprise pairs of opposite openings 40 facing in opposite circumferential directions. The pairs of openings 40 have diameters which increase in size from the lowermost pair to the uppermost pair. While the diameters of the openings will vary with the capacity of the ice-making apparatus, in an ice-making apparatus capable of producing about 500 pounds of ice per twenty-four hours, the diameters are in a range of about 0.125 inch at the top to 0.062 inch at the bottom. At least one inlet tube 42 is connected to the hollow tube 38 which inlet tube 42 is connected to a supply of a refrigerant (not shown) so that the refrigerant will flow into the hollow tube 38 and out through the openings 40 to lower the temperature of the hollow member 6 to form a layer of ice on the generally cylindrical surface 8. At least one outlet tube 44 is operatively connected to the sealed annular chamber 36 so that the spent refrigerant may be fed back to the compressor (not shown). A conventional insulating jacket (not shown) surrounds the hollow sleeve 30.

A discharge member 50 is mounted on the support flange 10 using a plurality of threaded bolts 52 passing through openings 54 and threaded into nuts 56 secured to the support flange 10. The discharge member 50 has a discharge tube 58 through which the ice particles pass to be discharged into a hopper (not shown). The discharge tube 58 has a longitudinal axis 60. A modified elbow portion 62 has an opening 64 in communication with the discharge tube 58 and an opening 66 in communication with the hollow member 6. The modified elbow portion 62 comprises an alcove-type recess having a generally oval-shape surface 68 which is generally elliptical and has a longitudinal axis 70 which is parallel to the longitudinal axis 26 but spaced therefrom along the longitudinal axis 60. An annular recess 72 is formed in the modified elbow portion 62 and is dimensioned to receive the upper end 74 of the hollow member 6. The discharge member 50 preferably is integrally molded using a plastic material such as an acrylonitrile butadiene styrene material or other materials having similar characteristics.

Figure 6:
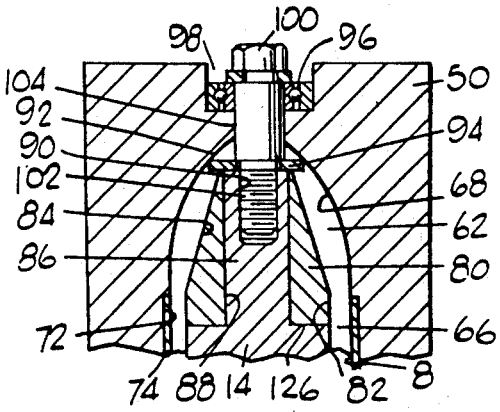
FIG. 6 is a cross-sectional view taken on the line 6—6 in FIG. 1.

Pressure forming means are provided for applying pressure on the removed ice being moved upwardly by the auger 12 and comprise a member 80 having a generally cylindrical outer surface 82, FIG. 6, opposite to and spaced from the generally cylindrical inner surface 8 of the upper end 74 of the hollow member 8. A generally conical outer surface 84 extends upwardly from the generally cylindrical outer surface 82. An extension portion 86 of the auger 12 extends upwardly through a bore 88 in the member 80. The uppermost portions of the member 80 and the extension portion 86 lie in a common plane. A threaded opening 90 extends downwardly into the extension portion 86. An annular washer 92 is seated on the uppermost portions of the member 80 and the extension portion 86 and has a central opening 94 in alignment with the threaded opening 90. A bearing 96 is seated in a recess 98 in the discharge member 50. A headed threaded bolt 100 extends downwardly through the bearing 96 and has a threaded end portion 102 in threaded engagement with the threaded opening 90. The headed threaded bolt 100 has a body portion 104 having a diameter greater than the diameter of the central opening 94 so that when the headed threaded bolt is tightened, it applies pressure to the member 80 and the extension portion 86 so that the member 80 rotates with the auger 12. When tightened, the lower end of the threaded end portion 102 is spaced from the lower end of the threaded opening 90. A recess 106, FIG. 1, is formed in the oval-shaped surface 68 and has an arcuate extent of about 180 degrees and has feathered end portions. The deepest portion of the recess 106 is at about the central portion thereof. A portion of the annular member 92 having an arcuate extent of about 180 degrees is present in the recess 106 as it rotates with the auger 12 and functions to apply back pressure on the removed ice being moved upwardly by the auger 12.

Figure 2:
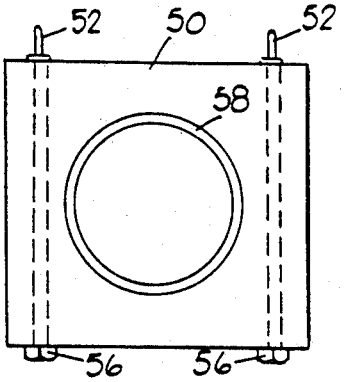
FIG. 2 is a side elevational view of the discharge section taken from the right side of FIG. 1.
Figure 3:
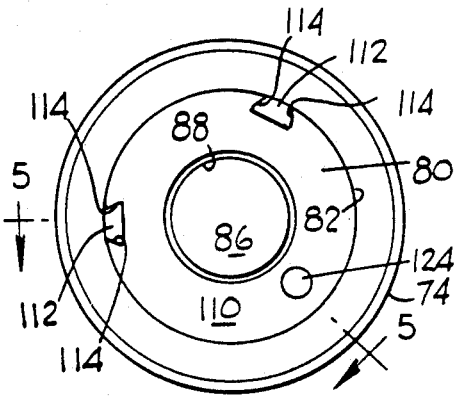
FIG. 3 is a bottom plan view of a portion of FIG. 1 with parts removed.
Figure 4:
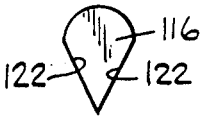
FIG. 4 is a front elevational view of an ice cutter.
Figure 5:
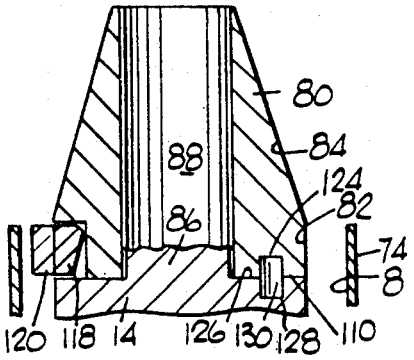
FIG. 5 is a cross-sectional view taken on the line 5—5 in FIG. 3 with an ice-cutter added.

The bottom surface 110 of the member 80 is illustrated in FIGS. 3 and 5 and has a plurality of recesses 112 formed therein and which recesses 112 have inclined sidewalls 114. Although only two recesses 112 are illustrated, it is understood that there can be more than two recesses 112. An ice cutter 116, FIG. 4, has a mounting portion 118 shaped similarly to the recesses 112 so that when inserted therein, the ice cutter 116 will be retained in the recesses 112. The operating portion 120 projects radially outwardly from the recess 112 and has inclined surfaces 122 having their narrowest portion located at the lowermost portion thereof so as to apply back pressure to the removed ice being moved upwardly by the auger 12. Another recess 124 is formed in the bottom surface 110 and is located equidistantly from the recesses 112. As illustrated in FIG. 5, the bottom surface 110 is in engagement with an annular surface portion 126 of the central body portion 14. A recess 128 is formed in the annular surface portion 126 and is located to be in radial alignment with the end of the ice shearing edge 20. A dowel pin 130 seated in the recesses 124 and 128 functions to locate the ice cutters 116 relative to the end of the ice shearing edge 20. Also, the dowel pin 130 functions to ensure that the member 80 rotates with the auger 12.

In operation, water is fed into the ice forming chamber 16 through the inlet tube 24 and maintained at a substantially constant level therein by conventional apparatus (not shown). Refrigerant is supplied to the hollow tube 38 through the inlet tube 42 and flows outwardly through the openings 40 into the sealed annular chamber 36 to reduce the temperature of the hollow member 6. Since the largest openings 40 are located in the uppermost portion of the hollow tube 38, this is the coldest location in the hollow member 6. As the temperature of the hollow member 6 is lowered, a layer of ice is formed on the generally cylindrical inner surface 8. As the auger 12 rotates, the ice shearing edge 20 removes the layer of ice from the generally cylindrical inner surface 8 and because of the helical flight 18 moves the removed ice upwardly. When the normal operating conditions have been reached, the annular washer 92 in conjunction with the oval-shaped surface 68 and the recess 106 exerts a back pressure force on the removed ice being moved upwardly by the helical flight 18 to form the removed ice into a hard form. The removed ice has very little rotational movement. The velocity of the rotation of the auger depends on the capacity of the ice-making apparatus. In the example given above of an ice-making apparatus having a capacity of about 500 pounds per 24 hours, the auger rotates at a velocity of about 13 revolutions per minute. As the auger 12 rotates, so do the ice cutters 116 so that they function to break the hard ice into particles of a desired size which are moved through the discharge tube 58. In operation, there is no excess water that has to be removed.

While an illustrative and presently preferred embodiment of the invention has been described in detail herein, it is to be understood that the inventive concept may be otherwise variously embodied and employed and that the appended claims are intended to be construed to include such variations except insofar as limited by the prior art.

What is claimed is:

1. Apparatus for producing ice particles comprising:

a housing mounted at a relatively fixed location;

a hollow member having a longitudinal axis and a generally cylindrical inner surface mounted on said housing so that it extends generally in a vertical direction;

an auger having a longitudinal axis coinciding with said longitudinal axis of said hollow member and mounted for rotational movement relative to said hollow member;

said auger having a generally cylindrical central body portion for providing an ice forming chamber between said generally cylindrical inner surface and said central body portion;

water supply means for maintaining a level of water in said ice-forming chamber;

ice forming means for forming a layer of ice on said generally cylindrical inner surface;

said auger having a helically extending flight having an ice shearing edge for removing said layer of ice from said generally cylindrical inner surface and for moving said removed ice in said vertical direction;

support means extending radially outwardly from said hollow member and spaced a predetermined distance below the upper end of said hollow member;

discharge means mounted on said support means and having a modified elbow portion and a discharge tube extending outwardly therefrom;

pressure forming means mounted on said central body portion for rotation therewith and located in said modified elbow portion for applying pressure on said ice being moved upwardly by said ice shearing edge and said helically-extending flight;

said pressure forming means having at least a generally conical outer surface extending upwardly into said modified elbow portion;

said discharge tube having a longitudinal axis perpendicular to said longitudinal axis of said auger; and said modified elbow having an inner surface, a portion of which comprises a partial generally oval surface located opposite to at least a portion of said generally conical outer surface and having a longitudinal axis extending parallel to said longitudinal axis of said auger but spaced therefrom a predetermined distance along said longitudinal axis of said discharge tube.

2. The invention as in claim 1 and wherein said ice making means comprises:

a hollow sleeve surrounding at least a portion of said hollow member and joined thereto to form a sealed annular chamber;

at least one hollow tube mounted in said sealed annular chamber and having a longitudinal axis parallel to said longitudinal axis of said hollow member;

said hollow tube having a plurality of vertically spaced apart openings formed therein;

at least one inlet tube connected to said hollow tube for supplying a refrigerant thereto so that said refrigerant may be dispersed through said vertically spaced apart openings; and at least one outlet tube for permitting escape of spent refrigerant from said sealed annular chamber.

3. The invention as in claim 2 wherein:

said plurality of spaced apart openings having diameters increasing in size from the lowermost opening to the uppermost opening.

4. The invention as in claim 2 wherein:

said plurality of openings comprising pairs of opposite openings facing in opposite circumferential directions; and said pairs of opposite openings having diameters increasing in size from the lowermost opposite pair of openings to the uppermost opposite pair of openings.

5. The invention as in claim 1 wherein:

said pressure forming means having a generally cylindrical outer surface opposite to and spaced from a portion of said generally cylindrical inner surface terminating at said upper end of said hollow member and located below said generally conical outer surface extending upwardly into said modified elbow portion.

6. The invention as in claim 5 and further comprising:

at least one ice cutter extending radially outwardly from said generally cylindrical outer surface.

7. The invention as in claim 5 and further comprising:

a plurality of circumferentially spaced apart ice cutters, each extending radially outwardly from said generally cylindrical outer surface.

8. The invention as in claim 7 and further comprising:

locating means for locating said plurality of cutters so that each of them are equidistantly spaced in opposite circumferential directions from the end of said helically extending flight.

9. The invention as in claim 5 and further comprising:

said oval surface of said modified elbow having an arcuate recess formed therein; and flange means at the upper extremity of said conical outer surface extending radially outwardly therefrom and having at least a portion thereof located in said arcuate recess.

10. Apparatus for producing ice particles comprising:

a housing mounted at a relatively fixed location;

a hollow member having a longitudinal axis and a generally cylindrical inner surface mounted on said housing so that it extends generally in a vertical direction;

an auger having a longitudinal axis coinciding with said longitudinal axis of said hollow member and mounted for rotational movement relative to said hollow member;

said auger having a generally cylindrical central body portion for providing an ice forming chamber between said generally cylindrical inner surface and said central body portion;

water supply means for maintaining a level of water in said ice-forming chamber;

ice forming means for forming a layer of ice on said generally cylindrical inner surface;

said auger having a helically extending flight having an ice shearing edge for removing said layer of ice from said generally cylindrical inner surface and for moving said removed ice in said vertical direction;

support means extending radially outwardly from said hollow member and spaced a predetermined distance below the upper end of said hollow member;

discharge means mounted on said support means and having a modified elbow portion and a discharge tube extending outwardly therefrom;

pressure forming means mounted on said central body portion for rotation therewith and located in said modified elbow portion for applying pressure on said ice being moved upwardly by said ice shearing edge and said helically-extending flight; and said pressure forming means having a generally cylindrical outer surface opposite to and spaced from a portion of said generally cylindrical inner surface at said upper end of said hollow member and a generally conical outer surface extending upwardly into said modified elbow portion.

11. The invention as in claim 10 and further comprising:

at least one ice cutter extending radially outwardly from said generally cylindrical outer surface.

12. The invention as in claim 10 and further comprising:

a plurality of circumferentially spaced apart ice cutters, each extending radially outwardly from said generally cylindrical outer surface.

13. The invention as in claim 12 and further comprising:

locating means for locating said plurality of cutters so that each of them are equidistantly spaced in opposite circumferential directions from the end of said helically extending flight.

14. The invention as in claim 10 and further comprising:

said modified elbow portion having an inner surface having an arcuate recess formed therein; and flange means at the upper extremity of said generally conical outer surface extending radially outwardly therefrom and having at least a portion thereof located in said arcuate recess.

15. The invention as in claim 14 and further comprising:

at least one ice cutter extending radially outwardly from said generally cylindrical outer surface.

16. The invention as in claim 14 and further comprising:

a plurality of circumferentially spaced apart ice cutters, each extending radially outwardly from said generally cylindrical outer surface; and locating means for locating said plurality of cutters so that each of them are equidistantly spaced in opposite circumferential directions from the end of said helically extending flight.

17. The invention as in claim 10 wherein:

said discharge tube having a longitudinal axis perpendicular to said longitudinal axis of said auger;

said modified elbow having an inner surface, a portion of which comprises a partial generally oval surface located opposite to at least a portion of said generally conical outer surface and having a longitudinal axis extending parallel to said longitudinal axis of said auger but spaced therefrom a predetermined distance along said longitudinal axis of said discharge tube.

18. Apparatus for producing ice particles comprising:

a housing mounted at a relatively fixed location;

a hollow member having a longitudinal axis and a generally cylindrical inner surface mounted on said housing so that it extends generally in a vertical direction;

an auger having a longitudinal axis coinciding with said longitudinal axis of said hollow member and mounted for rotational movement relative to said hollow member;

said auger having a generally cylindrical central body portion for providing an ice forming chamber between said generally cylindrical inner surface and said central body portion;

water supply means for maintaining a level of water in said ice forming chamber;

ice forming means for forming a layer of ice on said generally cylindrical inner surface;

said auger having a helically extending flight having an ice shearing edge for removing said layer of ice from said generally cylindrical inner surface and for moving said removed ice in a vertical direction;

ice particle forming means for forming said removed ice into ice particles; and said ice forming means comprising:

a hollow sleeve surrounding at least a portion of said hollow member and joined thereto to form a sealed annular chamber;

at least one hollow tube mounted in said sealed annular chamber and having a longitudinal axis parallel to said longitudinal axis of said hollow member;

said hollow tube having a plurality of vertically spaced apart openings formed therein;

at least one inlet tube connected to said hollow tube for supplying a refrigerant thereto so that said refrigerant may be dispersed through said vertically spaced apart openings; and at least one outlet tube for permitting escape of spent refrigerant from said sealed annular chamber.

19. The invention as in claim 18 wherein:

said plurality of spaced apart openings having diameters increasing in size from the lowermost opening to the uppermost opening.

20. The invention as in claim 18 wherein:

said plurality of openings comprising pairs of opposite openings facing in opposite circumferential directions.

* * * * *